US005323727A

United States Patent [19]

Heaton

[11] Patent Number: 5,323,727

[45] Date of Patent: Jun. 28, 1994

[54] GROUP UNDERWATER TOWING DEVICE

[76] Inventor: Richard A. Heaton, 43 Pueohala Pl., Kailua, Hi. 96734

[21] Appl. No.: 55,670

[22] Filed: Apr. 29, 1993

[51] Int. Cl.[5] ..... B63C 11/46

[52] U.S. Cl. ..... 114/315; 114/242

[58] Field of Search ..... 114/312, 315, 330, 331, 114/332, 270, 242, 244, 245, 253

[56] References Cited

U.S. PATENT DOCUMENTS

| | | | |
|---|---|---|---|
| 2,936,466 | 5/1960 | Szymczyk et al. . | |
| 2,948,247 | 8/1960 | Rebikoff | 114/315 |
| 3,420,202 | 1/1969 | Oversmith | 114/315 |
| 3,442,240 | 5/1969 | Wild et al. | 114/315 |
| 3,931,777 | 1/1976 | Colgan . | |
| 4,348,976 | 9/1982 | Gilbert | 114/270 |
| 4,602,589 | 7/1986 | Quinata | 114/315 |
| 4,624,207 | 11/1986 | King | 114/315 |
| 5,082,464 | 1/1992 | Clink | 440/6 |

*Primary Examiner*—Jesus D. Sotelo
*Attorney, Agent, or Firm*—Martin E. Hsia

[57] ABSTRACT

A first elongated buoyant float (20) and a second elongated buoyant float (40) are joined by a joining member (50) to form a substantially "V"-shaped frame. A propulsion unit (60) is pivotably mounted at the apex of the frame and can be controlled through a pistol grip (70) having a trigger (72). Participants in a guided group underwater tour can hold onto handrails (24) and (44) and be provided with air through regulators (32) provided through air hoses (30). The handrails (24) and (44) are preferably zig-zag in shape. Optionally, audio communications means can be provided to the tour participants. An alternative embodiment includes a "V" shaped frame (112) having zig-zag legs (**112*b*) with two main floats (120, 140) and two outrigger floats (114, 116) at the ends of the legs. Another alternative embodiment comprises a "U" shaped float (202) with a handrail (224) that is guided with guiding fins (212**).

36 Claims, 5 Drawing Sheets

FIG. 8
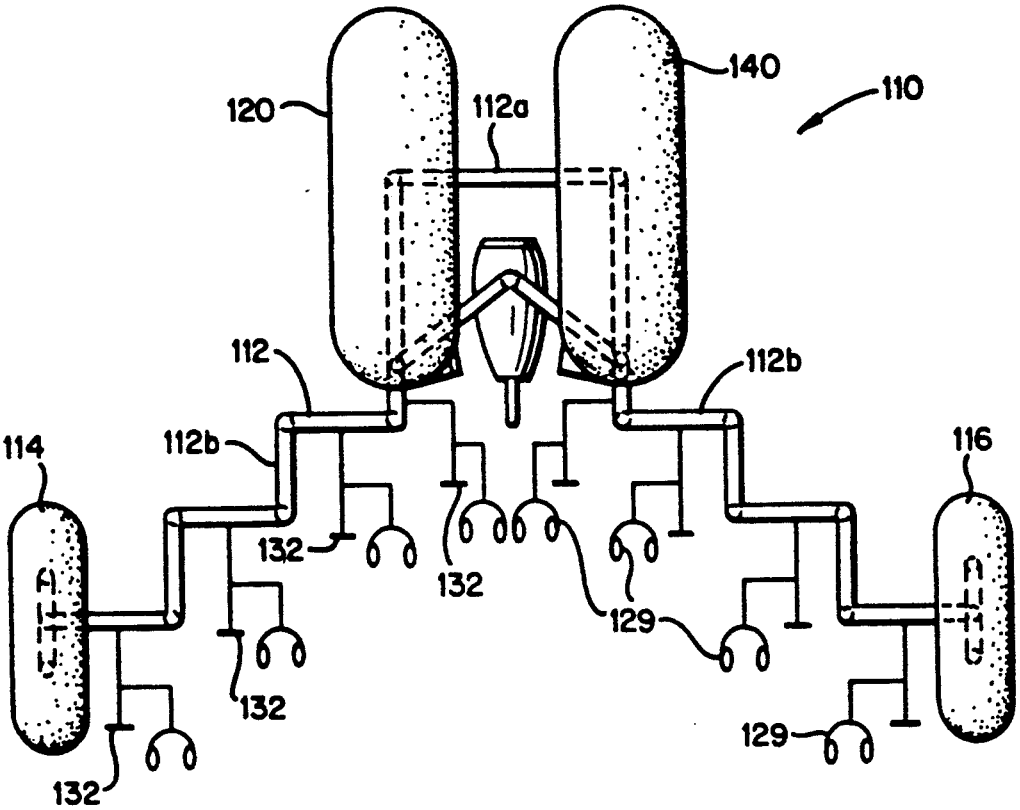
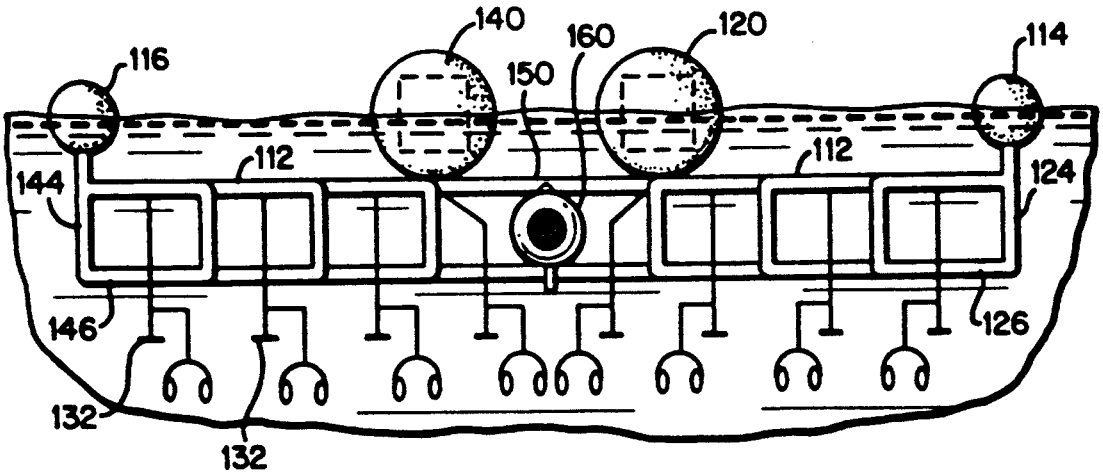
FIG. 9

GROUP UNDERWATER TOWING DEVICE

DESCRIPTION

1. Technical Field

This invention relates to a device for conveying a group of participants and a tour guide on an underwater tour of marine environments. The device provides the tour participants and guide with means to breathe underwater, propulsion, a light source for nighttime under-water viewing, and an emergency flotation device.

Increasing awareness of the marine environment has led to a strong interest on the part of many people to experience this environment first hand, by actually entering the environment. Face masks and snorkels have been developed in order to allow people to experience the marine environment with the head submerged, while floating or swimming on or immediately below the surface of the water. However, because the upper end of a snorkel must extend above the surface of the water, a person using a snorkel cannot remain completely submerged for extended and continuous periods, so that the user is very conscious that he or she is floating on top of the water, instead of actually being underwater.

Self contained underwater breathing apparatus (SCUBA) was developed to permit people to swim below the surface of the water for extended periods. SCUBA employs bulky air tanks and other apparatus, but the same freedom to swim below the water's surface can be achieved by having air piped from an air source through a hose to a regulator-mouthpiece, which is worn by the swimmer. This approach is often referred to as a "hookah" arrangement, named after the Turkish water pipe. Thus, the swimmer can experience the freedom associated with breathing under water, encumbered by much less apparatus.

The marine environment is strange and new to most people. Natural "open ocean" marine environments, such as coral reefs, are fraught with uncertainties, including periodic murky water, uncontrolled wave action, and dangerous marine animals, such as fire corals, eels, and sharks. As a consequence, businesses have developed which offer expert guides who lead groups of participants on underwater tours of coral reefs and similar marine environments.

Because swimming capabilities of participants differ widely, it is often difficult for a group tour guide to keep the members of the group together, safe, and out of harm's way. Further, because many participants might not be able to swim at all (or be very weak swimmers), it is important that participants be able to easily raise their heads above water in case they panic.

It is therefore an object of this invention to provide a means to keep an underwater tour group together by providing the participants with a towing means to compensate for the differences in swimming ability and differences in stamina and endurance.

It is a further object of this invention to provide the tour guide and participants a source of regulated air to breathe as they enjoy the underwater experience.

It is a still further object of this invention to provide the underwater tour guide with a means to maneuver the towing device in such directions as the guide wishes.

It is a still further object of this invention to provide handrails for tour participants by which they may-be towed through the underwater experience.

It is a still further object of this invention to provide a group underwater towing device of such configuration that each tour participant may have an unobstructed view of the marine environment ahead, below and to at least one side.

It is a still further object of this invention to provide an underwater towing device which positions tour participants close to their tour guide, in case of emergencies.

It is a still further object of this invention to provide such a device that allows tour participants to easily put their heads above water if they desire.

It is a still further object of this invention to provide a safety flotation system for underwater tour participants.

It is a still further object of this invention to provide such a device having an audio communication system so that tour participants can hear a prerecorded or live narration or other audio program while on a tour.

2. Background Art

U.S. Pat. No. 4,348,976 to Gilbert discloses a powered floating vessel that can tow a diver to a diving location and then provide compressed air to the diver after arriving at the diving location.

U.S. Pat. No. 2,948,247 to Rebikoff discloses a powered submarine vessel having two parallel substantially cylindrical shells designed to have two divers sit on the shells. No breathing apparatus for the divers is provided.

U.S. Pat. No. 3,420,202 to Oversmith discloses a submersible craft for a diver wearing scuba gear powered by an internal combustion engine.

U.S. Pat. No. 4,602,589 to Quinata discloses a board having an elongated buoyant body with a recess formed therein and a motor for towing swimmers wearing snorkeling apparatus across the surface of the water.

U.S. Pat. No. 3,442,240 to Wild et al. discloses a powered swimming aid having a floatable housing and an electric motor. No breathing apparatus is provided.

U.S. Pat. No. 3,931,777 to Colgan discloses an aqua sled having a transparent floor but no propulsion system or breathing apparatus.

U.S. Pat. No. 2,936,466 to Szymczyk et al. discloses a foldable underwater sled that can be converted to a surfboard. No breathing or propulsion apparatus is provided.

U.S. Pat. No. 5,082,464 to Clink discloses a float with a motor to hold apparatus for divers.

DISCLOSURE OF INVENTION

The above objects and other objects of the invention are achieved by a device comprising a holding means for participants to hold onto while participating in a tour, a buoyancy means having a bottom surface for providing buoyancy to the holding means, and an audio system attached to the buoyancy means for allowing participants to hear a program while submerged and holding onto the holding means. The holding means is preferably handrails and the buoyancy means is preferably a float or floats.

In a first preferred embodiment, the device comprises a "V" shaped frame having an apex, preferably formed from two elongated buoyant floats joined by a joining member at the forward end of each float. Handrails for underwater tour participants are attached to each float, preferably extending downward and rearward from each float to a sufficient depth below the bottom surface of the floats that the floats do not obstruct the forward view of the tour participants and the tour participants are completely submerged. Preferably, each handrail accommodates a plurality of participants, although individual handrails can be provided instead. A propulsion means, preferably an electric motor driving a propeller inside a housing, is preferably pivotably mounted on a downwardly extending part of the joining member at the apex. A control means for controlling and steering the motor, preferably a pistol grip hand control, is operably connected to the housing, to start and stop the electrical motor, as well as to control the direction of thrust and thus, to control the direction of movement of the device. The joining member at the apex of the "V" preferably extends downwardly and the thruster is preferably mounted on the member below the surface of the water at a sufficient depth that the guide's forward visibility is unimpaired by the floats.

The floats preferably contain sources of electrical power and compressed air. Waterproof cable preferably connects the electrical power source to the electric motor.

Air hoses preferably extend from the compressed air source through the body of the floats, and to participant breathing means, preferably conventional breathing regulators, located conveniently near the handrails for each tour participant, as well as for the tour guide, although the tour guide also can have SCUBA gear for freedom of movement.

The floats are preferably sufficiently buoyant that they are less than half-submerged when in use. This allows one or more tour participants to come to the surface and utilize the towing device as a flotation device, in the event of an emergency.

The handrails are positioned so that they are at a sufficient depth below the surface of the water to provide the tour participants a forward view unimpaired by the submerged portion of the floats, as well as to engender in the participants the feeling of being submerged. Preferably, the handrails have a zig-zag shape.

The angle and distance between the floats, as well as the matching angles and distances between various forward facing parts of handrails, are such that each participant is spaced outward and rearward of the next participant, to maximize the sideways viewing angle. As all participants are at roughly the same depth, the downward view is unimpeded.

The floats are preferably constructed from fiberglass or other waterproof polymeric composite materials, or a suitable metal such as light gauge stainless steel. Handrails are also preferably constructed from polymeric composites or metals. Preferably, water tight hatches provide access to the electrical power and compressed air sources in the floats. Preferably, hose fittings extending through the surfaces of the floats are also sealed with water tight seals.

The propulsion means preferably comprises an electric motor drivably engaged with a propeller, the motor and the propeller preferably being enclosed in a housing configured to allow water to pass into and through the propeller, and to be forced out the rear of the housing. An extension of the housing is preferably configured as a pistol-type grip containing a trigger-style waterproof electrical switch which supplies electricity to the motor. The housing is preferably pivotably mounted on the joining member. The housing is preferably provided with a grill that permits the passage of water while preventing solid objects such as fish or human body parts from coming into contact with the propeller.

The electrical power source for the motor may comprise rechargeable batteries, a fossil-fuel driven internal combustion engine driving a generator, or a bank of solar cells. In the latter event, the solar cells would be installed on top of the floats.

The source of compressed air preferably would be mounted on or in the floats and may consist either of one or more compressed air tanks, or an air breathing internal combustion engine driving an air compressor.

A single internal combustion engine mounted on or in the floats may be used to drive both an electric generator and an air compressor, with the generator in turn powering the electric motor. Of course, an internal combustion engine could also be drivably engaged with the propeller through a waterproof transmission instead of running a generator to power the electrical motor.

Preferably, an audio communication means for providing audio communications or prerecorded music or information can be provided for the participants, such as headsets.

In a second preferred embodiment, the device comprises a substantially V-shaped frame having an apex, a first leg having a first distal end, and a second leg having a second distal end. Preferably, the legs of the frame have a zig-zag shape. A main float means is attached to the apex, a first outrigger float is attached to the first distal end, and a second outrigger float is attached to the second distal end. The holding means comprises a first handrail attached to the first leg and a second handrail attached to the second leg. Preferably, the handrails have the same zig-zag shape as the legs of the frame. The main float means preferably comprises two main floats attached to the sides of the apex, which provide most of the necessary buoyancy for the device. The outrigger floats are provided so that, if the participant farthest from the apex desires to raise his or her head above water or otherwise pulls down on his or her handrail, the device will remain substantially horizontal, rather than tilting. The other elements of this second embodiment (such as breathing means, audio communications means, control means, holding means and propulsion means) are substantially the same as in the first embodiment.

In a third preferred embodiment, the device comprises a substantially "U" shaped float having two legs and a crossbar. Preferably the direction of movement is parallel to the legs, with the crossbar defining the forward end. A handrail is preferably provided under the crossbar. This embodiment is preferably used in a controlled environment having a controlled water flow and an underwater guidance system, in which case the device would be propelled by the water flow, thus obviating the need for a propulsion system. Such a guidance system would preferably comprise transparent rails, preferably of transparent acrylic plastic, that would cooperate with guiding fins on the legs of the device itself. The other elements of this embodiment would be substantially the same as for the first and second embodiments.

BRIEF DESCRIPTION OF DRAWINGS

FIG. 8 is a top plan view of an alternate embodiment having a "V" shaped frame with zig-zag legs, two main floats located adjacent to the apex of the frame, and two outrigger floats at the ends of the legs of the frame.

FIG. 9 is a front elevational view of the embodiment of FIG. 8.

BEST MODES FOR CARRYING OUT INVENTION

Figure 1:
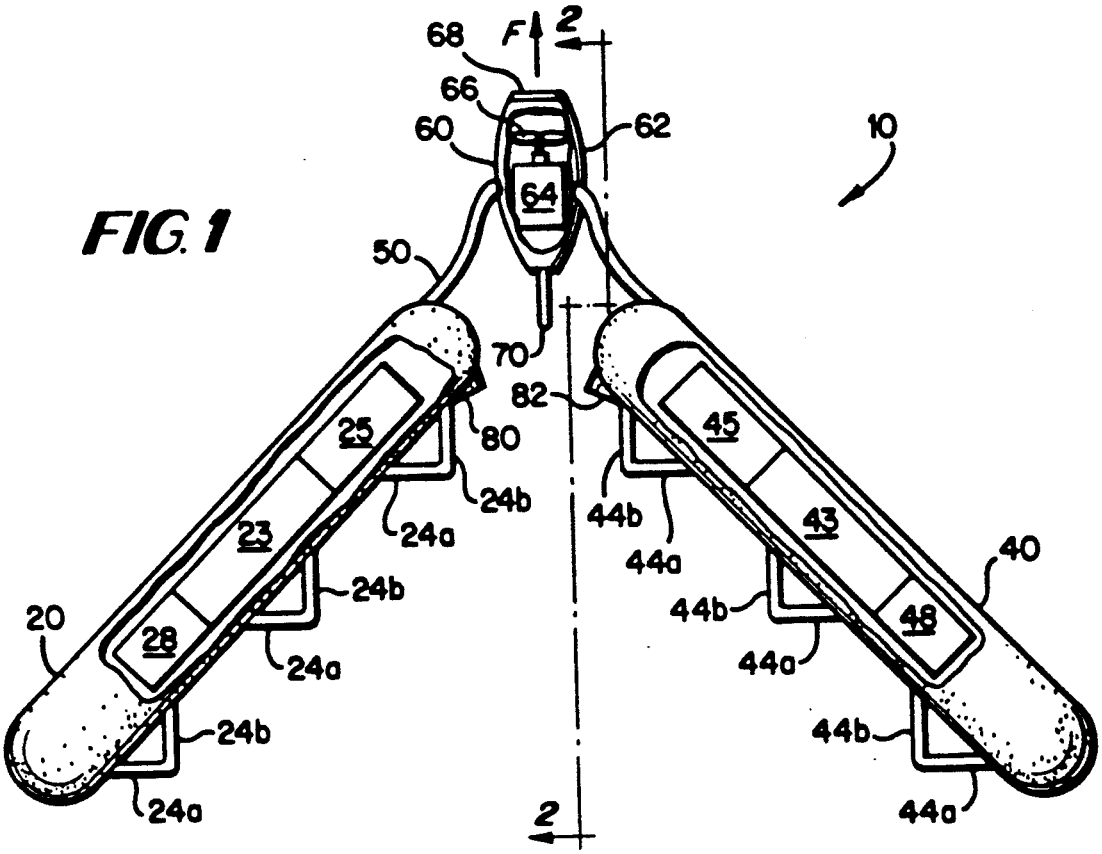
FIG. 1 is a top plan cut away view of a preferred embodiment of a device in accordance with this invention.

Referring to FIG. 1, shown is a top plan cut away view of a first preferred embodiment of a group underwater towing device in accordance with this invention. The device 10 comprises a first elongated buoyant float 20 and a second elongated buoyant float 40 joined together by a joining member 50 having a downwardly extending part to form a substantially "V" shaped frame. The "V" shaped frame defines a forward direction F. As can be better seen from FIG. 2 and FIG. 4, a propulsion unit 60 is pivotably mounted on the downwardly extending part of the joining member 50 to provide propulsion. Each of the floats 20 and 40 supports a conventional air supply 23 and 43, which can comprise tanks of compressed air or an air compressor powered by an air breathing internal combustion engine that runs on a fossil fuel, preferably butane, which will not pollute the environment if it spills. Each of the tanks 20 and 40 also preferably provides or contains a conventional source of electrical power 25 and 45, which can be conventional batteries, solar cells, or any other known source of electrical energy, such as a generator powered by an engine running on fossil fuel. Of course, if the source is solar cells, they can be placed on the floats, rather than inside the floats.

The propulsion unit 60 preferably comprises a streamlined housing 62 containing a conventional motor 64, preferably an electric motor, drivably engaged with a conventional propeller 66. A grill 68 is preferably provided at the front of the housing 62 to prevent contact with the propeller 66. A control means 70, preferably a pistol grip with a trigger 72 (exaggerated for clarity) is preferably attached to the rear of the housing 60.

Figure 6:
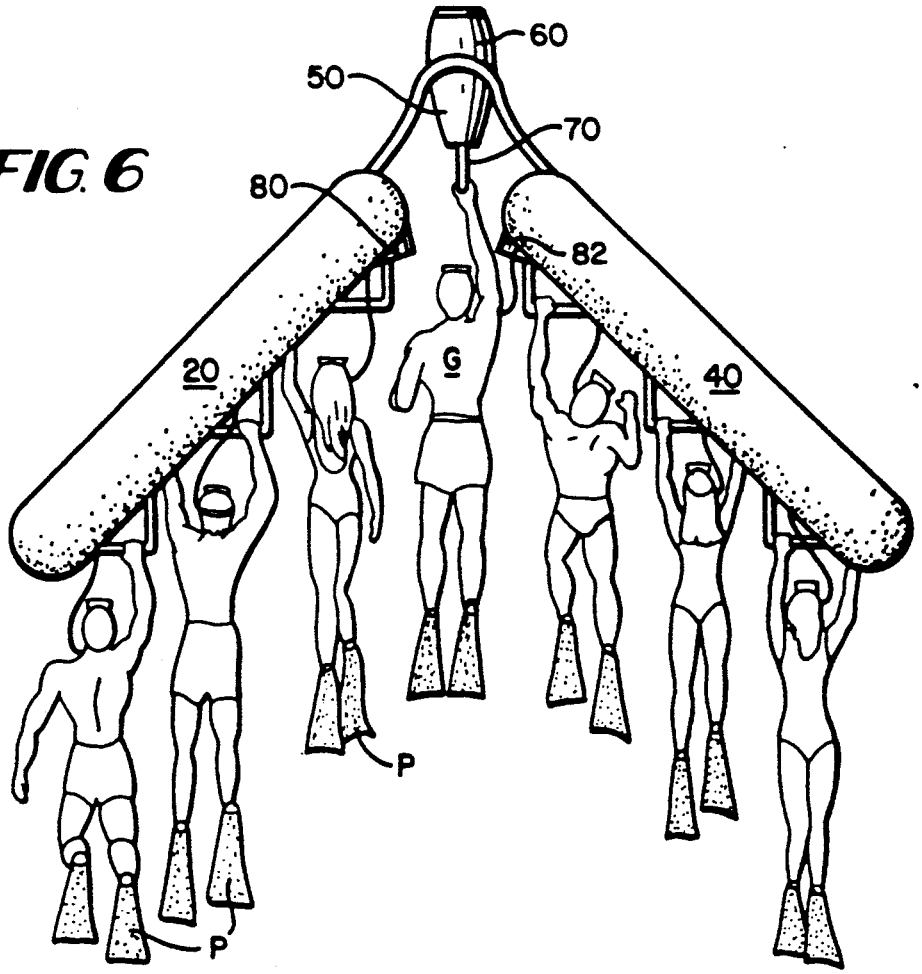
FIG. 6 is a plan view of the embodiment of FIG. 1 being used by a tour guide and a tour of 6 tour participants.

Mirrors 80 and 82 are preferably provided near the front ends of the floats 20 and 40 so that a guide grasping the control 70 will be able to see the participants holding onto the handrails on the floats 20 and 40 (see FIG. 6).

Optionally, an audio communications means, preferably an electronic audio source 28, can be provided, preferably in one float. If participants speak different languages, a different source 48 could be provided in the other float. The audio sources 28 and 48 preferably would be operably connected to listening devices 29, preferably headsets (exaggerated for clarity) with wires that are wound around the air hoses 30. The audio sources could provide a pre-recorded program, a microphone, or some other audio source. Such a system would allow the participants to be aurally guided through a tour either by the guide or by a pre-recorded program.

Figure 2:
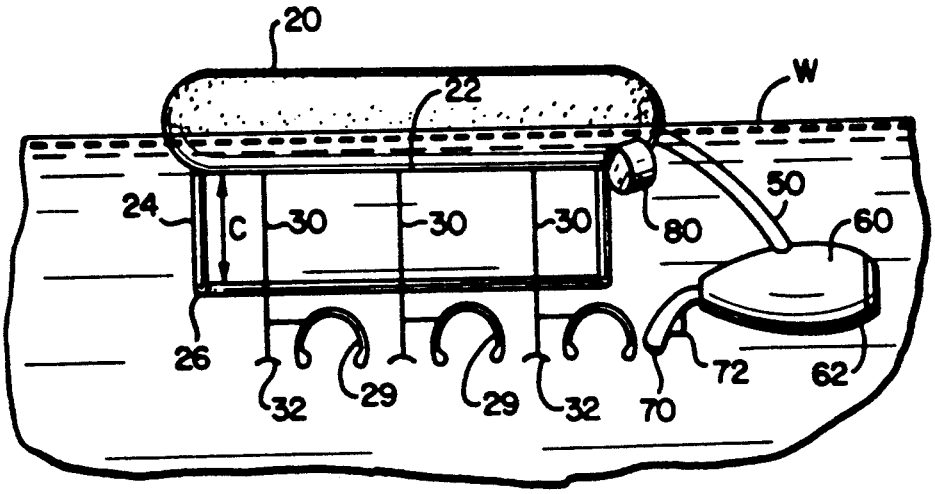
FIG. 2 is a side elevational view along the line 2—2 of FIG. 1.

Referring to FIG. 2, shown is a side view of the embodiment of FIG. 1 along the line 2—2 of FIG. 1. As can be seen, the first buoyant float 20 has a bottom surface 22 when the float is floating in the water W. As can also be seen, preferably the first buoyant float 20 is sufficiently buoyant that more than half of the float is above the waterline W. A first handrail 24 is attached to the first buoyant float 20 and extends downwardly to a handrail depth 26, the distance between the bottom surface 22 and handrail depth 26 defining a sight clearance C, preferably approximately half a meter or approximately eighteen inches, or less. It is preferred that only the two ends of each of the handrail 24 and 44 be attached to the floats in order to minimize the number of connections that must be made with the float, which will minimize the number of holes that must be made in the float. Preferably, each of the handrails 24 and 44 has a plurality, preferably 3, participant holding portions 24*a* and 44*a*, that are approximately perpendicular to the forward direction F. The participant holding portions are linked together by linking portions 24*b* and 44*b*, which are approximately parallel to the forward direction F. A plurality, preferably 3, of air hoses 30 is operably connected to the compressed air supply 24 and extends below the bottom surface 22 into close proximity with the portion of the handrail 24 that is at the handrail depth 26. Each of these air hoses 30 is preferably provided with a conventional air regulator 32.

Because of the buoyancy of the floats 20 and 40, the bottom surfaces of the floats 22 and 42 are relatively close to the surface of the water W. Thus, a participant holding on the handrails 24 and 44 at the handrail depth 26 and 46 can easily push upwards and bring his or her head above the surface of the water W, while still holding onto the handrails 24 and 44. This will provide psychological security to participants who are weak swimmers because they will know that they can always bring their heads above the water without releasing the handrails. In order to retain this ability, it is necessary that the handrails 24 and 44 extend rearwardly of the floats 20 and 40 so that the floats 20 and 40 will not prevent participants from bringing their heads above the water W.

Figure 3:
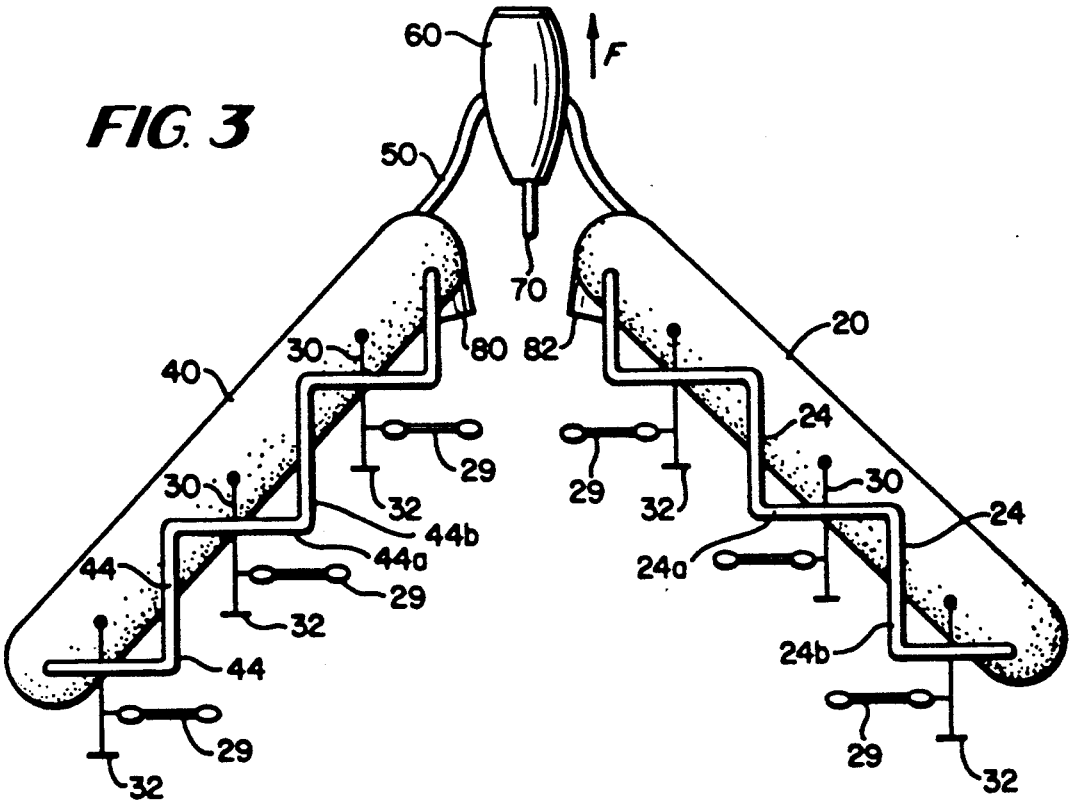
FIG. 3 is a bottom view of the embodiment of FIG. 1.

Referring to FIG. 3, shown is a bottom view of the embodiment of FIG. 1. It can be seen that the handrail 24 on the first float 20 and the handrail 44 on the second float 40 are in the shape of a zig-zag so that each of the participants can hold onto forward facing portions of the handrails.

Figure 4:
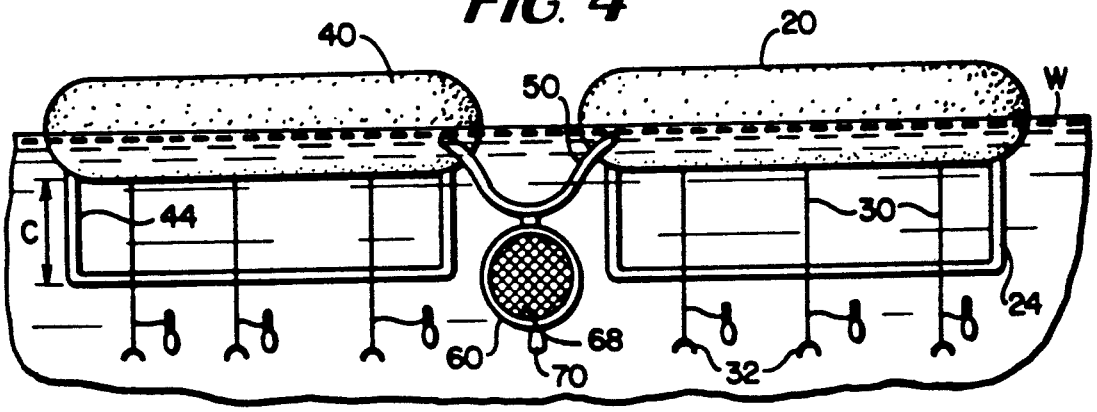
FIG. 4 is a front view of the embodiment of FIG. 1.

Referring to FIG. 4, shown is a front view of the embodiment of FIG. 1, showing the first and second buoyant floats 20 and 40, the joining member 50 and the propulsion unit 60 with pistol grip handle 70. Also shown are the handrails 24 and 44 and the air hoses 30 and conventional regulators 32, as well as the sight clearance C.

Figure 5:
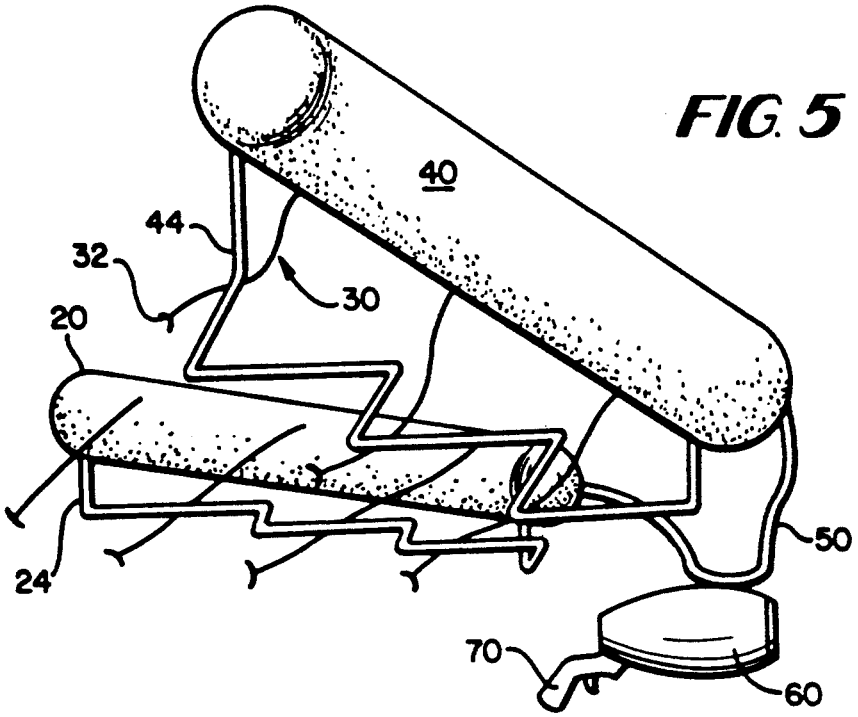
FIG. 5 is a side perspective view from the bottom of the embodiment of FIG. 1.

Referring to FIG. 5, shown is a bottom perspective view of the embodiment of FIG. 1, showing the two buoyant air tanks 20 and 40 forming a "V" shape with the joining member 50, the propulsion unit 60 with the pistol grip 70 being mounted on the joining member. The zig-zag shape of the handrails also is shown as are the air hoses 30 and the conventional regulators 32.

Referring to FIG. 6, shown is a plan view of the embodiment of FIG. 1 being used by a tour guide G and a tour of six tour participants P. As can be seen from FIG. 6, because the formation of the tour participants P is staggered due to the substantially "V" shaped frame of the device, each of the participants P has an unobstructed view to his or her respective side. The "V" shape of the frame also reduces hydrodynamic drag.

Figure 7:
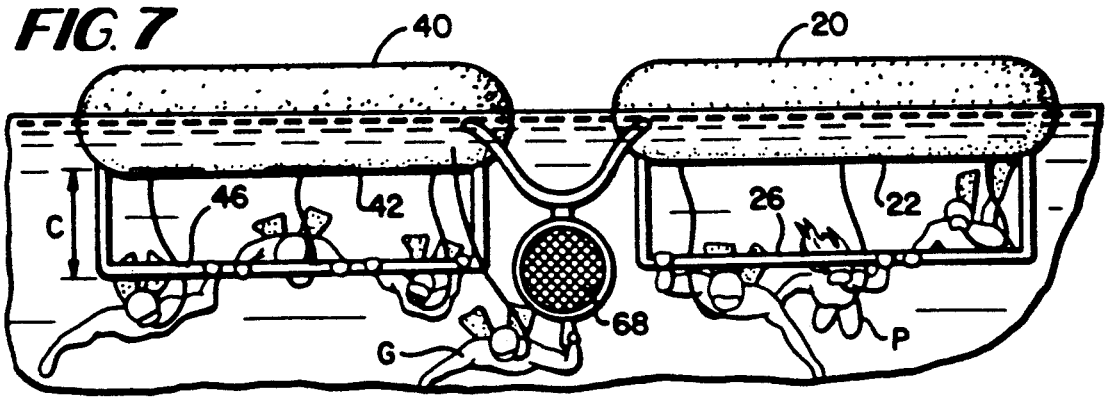
FIG. 7 is a front view of the embodiment of FIG. 1 being used by a tour guide and a tour of 6 participants.

Referring to FIG. 7, shown is a front view of the embodiment of FIG. 1 being used by a tour guide G and a group of six tour participants P. As can be seen, because of the sight clearance C between the handrail depth 26 and 46 and the bottom surface 22 and 42, each of the participants P has a view forward that is unobstructed by the floats 20 and 40. As can also be seen from FIG. 7, each of the participants has an unobstructed view downwards as well.

Referring to FIG. 8, shown is a top view of a second preferred embodiment of a group underwater towing device in accordance with this invention. This embodiment might be preferred if the hydrodynamic drag on the first embodiment is unacceptably high or for other reasons. This embodiment 110 comprises a substantially "V" shaped main frame 112, preferably having a rectangular portion 112*a* at the apex and having zig-zag legs 112*b*. A first elongated float 120 is mounted on one side of the rectangular portion 112*a* of the apex of the frame 112 and a second buoyant float 140 is mounted on a second side of the rectangular portion 112*a* of the apex of the frame 114 opposite the first buoyant float 120. Preferably the frame 112 comprises hollow tubing, preferably made of metal.

As can be better seen from the FIG. 9, the apex 112 of the frame also is provided with a downwardly extending part 150, and a propulsion unit 160 is pivotably mounted on that downwardly extending part 150. As in the case of the first preferred embodiment, each of the floats 120 and 140 supports an air supply, an electrical power source and an audio communications means (not shown). The propulsion unit would be basically the same as in the first embodiment.

At the ends of the legs 112*b* of the frame 112 are mounted two outrigger floats 114 and 116. Participant breathing means 132 and participant audio communications means 129 are also provided.

Referring to FIG. 9, shown is a front elevational view of the embodiment of FIG. 8. Preferably, air for the participant breathing means 132 is pumped from the floats 120 and 140 through the hollow frame 112, which thus serves as a distribution pipe for the air supply. Of course, interior tubing could be provided in the frame 112 so that the air can continue to be supplied to the participant breathing apparatus 132 even if a portion of the frame 112 leaks. The frame 112 is preferably at substantially the same depth as the bottom of the floats 120 and 140.

Handrails 124 and 144 are preferably attached to, and extend downwardly from, the frame 112 to a handrail depth 126 and 146. The distance between the frame 112 and the handrail depth 126 and 146 is defined as a sight clearance C, just as in the first embodiment. An advantage of this embodiment is that a participant can be submerged at a lower handrail level 126 and 146 because, if the participant wishes to, he or she can release the handrail 124 and 144 and instead hold onto the frame 112, which would be at a frame depth D, and then the participant would be able to bring his or her head above the water level W from the frame depth D. This therefore would allow participants to be submerged even deeper than in the first embodiment, thus enhancing the undersea experience, yet still providing a participant the ability to bring his or her head above water easily.

Figure 10:
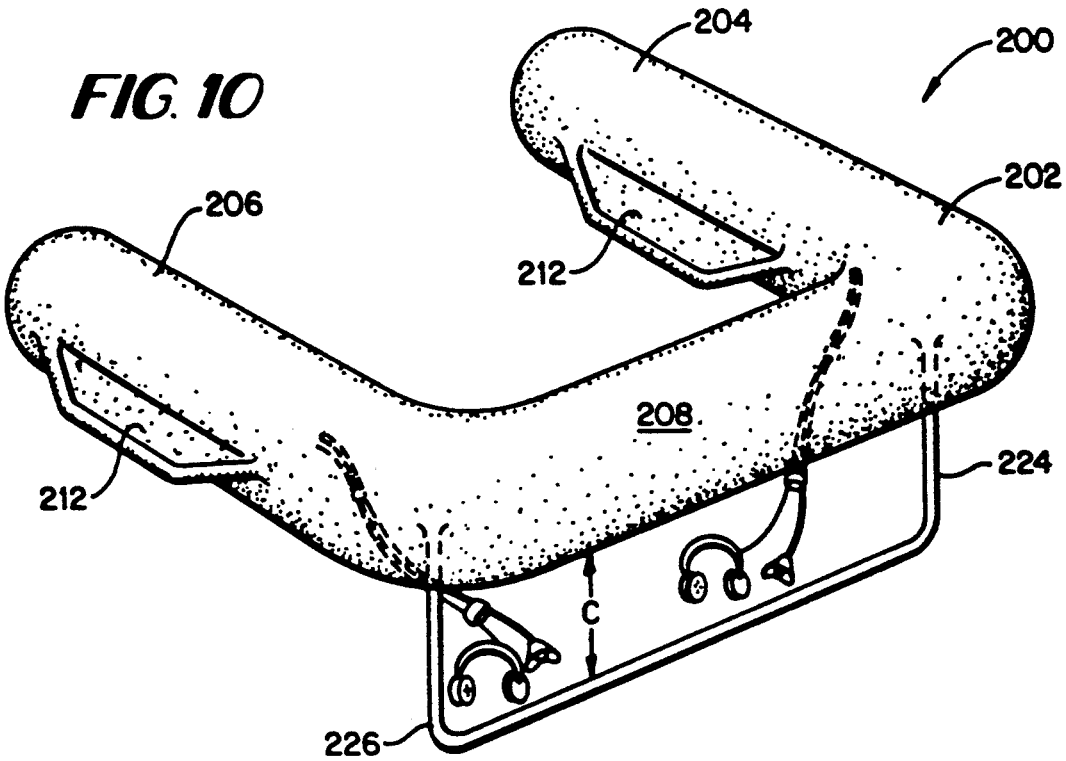
FIG. 10 is a perspective view of another embodiment having a main float, a downwardly extending handrail and guide fins.

Referring to FIG. 10, shown is a third embodiment of the present invention. This embodiment 200 provides a substantially "U" shaped float 202 having a first leg 204 and a second leg 206 with a front crossbar portion 208. The legs 204 and 206 are also provided with guiding fins 212 to stabilize the device 200 as it is carried along in a current in a direction parallel to the legs 204 and 206, with the crossbar 208 first. A handrail 224 is attached to the crossbar portion 208 and extends downwardly to a handrail depth 226, with the distance between the bottom of the float 202 and the handrail depth 226 defining a sight clearance C, as was the case with the other embodiments. The other components for this embodiment are substantially the same as in the other embodiments, except that no propulsion means is provided.

Figure 11:
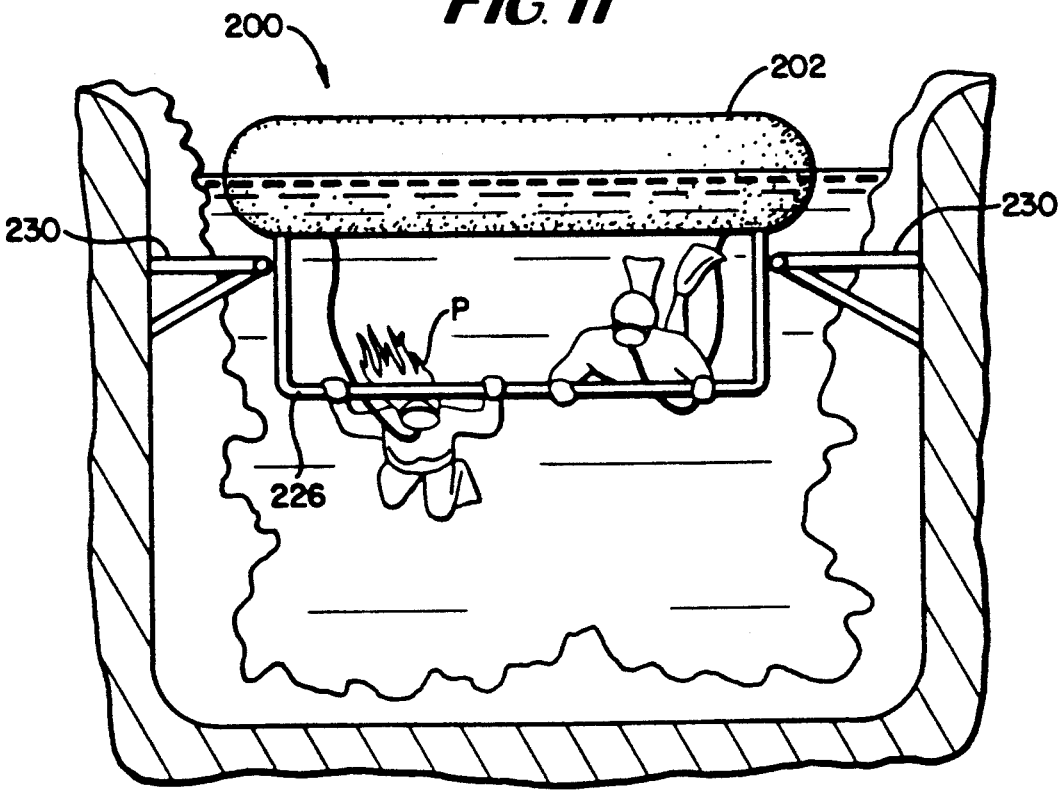
FIG. 11 is a front elevational view of the embodiment of FIG. 10 being used by two participants and being guided through a swim-through aquarium trail.

Referring to FIG. 11, shown is a front elevational view of the embodiment of FIG. 10 being used in an underwater trail having a controlled water flow. As can be seen, the trail is provided with a guidance system that includes guide rails 230, preferably made of transparent acrylic plastic. Preferably this environment is provided with a controlled water flow so that the device 200 does not require a propulsion system, but rather is carried along by the water flow through the trail, while being guided by the guide rails 230. As can be seen, this embodiment is suited for smaller groups of participants P, and can be used in man-made or other limited aquatic environments. Indeed, because this embodiment is to be used in limited aquatic environments, participants do not need a guide.

The invention has been described with respect to certain particular preferred embodiments. It will be obvious to those skilled in the art that changes and modifications can be made to the embodiments described above without departing from the scope and spirit of the invention. Accordingly, no limitations are to be inferred in the scope of the invention except as explicitly and specifically set forth in the attached claims.

Industrial Applicability

This invention is applicable anywhere that group underwater tours are desired to be conducted.

What is claimed is:

1. A group underwater towing device for towing participants in a group underwater tour, comprising:

a holding means for participants to hold onto while participating in said tour;

buoyancy means having a bottom surface for providing buoyancy to said holding means, said holding means being attached to said buoyancy means and extending downwardly from said buoyancy means to a holding means depth, said bottom surface and said holding means depth defining a sight clearance; and audio communications means attached to said buoyancy means for allowing participants to hear a program while submerged and holding onto said holding means.

2. A device according to claim 1, further comprising:

participant breathing means attached to said buoyancy means for allowing participants to breathe while submerged and holding onto said holding means.

3. A device according to claim 1, wherein said sight clearance is approximately half a meter.

4. A device according to claim 1, wherein said holding means depth is sufficiently shallow that a participant can bring his head above water while still holding onto said holding means.

5. A device according to claim 1, further comprising propulsion means for propelling said buoyancy means attached to said buoyancy means.

6. A device according to claim 1, wherein said buoyancy means comprises a first elongated buoyant float having a first front end, a second elongated buoyant float having a second front end, and a joining member attached to said front ends and positioning said floats to form a substantially V-shaped float.

7. A device according to claim 6, wherein said holding means comprises a first handrail mounted on said first float and a second handrail mounted on said second float.

8. A device according to claim 7, wherein said handrails are zig-zag in shape.

9. A device according to claim 1, wherein said buoyancy means comprises:

a substantially V-shaped frame having an apex, a first leg having a first distal end, and a second leg having a second distal end;

a main float means attached to said apex;

a first outrigger float attached to said first distal end; and a second outrigger float attached to said second distal end;

wherein said holding means comprises:

a first handrail attached to said first leg; and a second handrail attached to said second leg.

10. A device according to claim 1, wherein said buoyancy means comprises a substantially "U"-shaped float.

11. A group underwater towing device for towing participants in a group underwater tour, comprising:

a substantially "V"-shaped frame having a first leg, a second leg, an apex and a bottom surface, whereby said frame and said apex define a forward direction;

buoyancy means for providing buoyancy to said frame attached to said frame;

a handrail mounted on said frame extending downwardly below said bottom surface to a handrail depth, said handrail depth and said bottom surface defining a sight clearance.

12. A device according to claim 11, further comprising:

participant breathing means attached to said frame for allowing a participant to breathe while submerged and holding onto said handrail and being towed.

13. A device according to claim 11, further comprising:

propulsion means for propelling said frame and said participants through water mounted on said frame.

14. A device according to claim 11, wherein said buoyancy means and said frame are integrally formed and comprise:

a first elongated buoyant float having a first front end;

a second elongated buoyant float having a second front end;

a joining member having a downwardly extending portion attached to said front ends and positioning said floats to form said "V" shaped frame;

whereby said first float defines said first leg, said second float defines said second leg, and said joining member defines said apex.

15. A device according to claim 11, wherein said buoyancy means comprises:

main floating means attached to said apex for providing buoyancy at said apex; and first outrigger floating means attached to said first leg; and second outrigger floating means attached to said second leg.

16. A device according to claim 15, wherein said main floating means comprises:

a first main float attached to said frame adjacent to a first side of said apex; and a second main float attached to said frame adjacent to a second side of said apex.

17. A device according to claim 15, wherein each of said outrigger floating means comprises:

a float at the end of one of said legs opposite said apex.

18. A device according to claim 11, wherein said handrail has a zig-zag shape.

19. A device according to claim 11, further comprising:

audio communications means attached to said frame for allowing participants to hear a program while submerged and holding onto said handrail and being towed.

20. A group underwater towing device for towing participants in a group underwater tour, comprising:

a first elongated buoyant float having a first front end and a first bottom surface;

a second elongated buoyant float having a second front end and a second bottom surface;

a joining member having a downwardly extending portion attached to said front ends and positioning said floats to form a "V" shaped frame having an apex, whereby said floats form the legs of said frame and said joining member forms the apex of said frame, and whereby said frame and said apex define a forward direction;

a first handrail mounted on said first float extending downwardly below said first bottom surface to a first handrail depth, said first handrail depth and said first bottom surface defining a first sight clearance;

a second handrail mounted on said second float extending downwardly "below said second bottom surface to a second handrail depth, said second handrail depth and said second bottom surface defining a second sight clearance; and participant breathing means attached to said frame for allowing a participant to breathe while submerged and holding onto said handrail and being towed.

21. A device according to claim 20, further comprising:

propulsion means for propelling said floats and said joining member through water mounted on said frame.

22. A device according to claim 20, wherein said joining member has a downwardly extending part; and wherein said propulsion means comprises:

a streamlined housing pivotably mounted on said downwardly extending part;

a motor mounted in said housing;

a propeller drivably engaged with said motor; and control means for controlling and steering said motor.

23. A device according to claim 20, wherein said handrails extend from said floats in a rearward direction that is opposite from said forward direction.

24. A device according to claim 20, wherein said floats are approximately perpendicular to each other.

25. A device according to claim 20, wherein said first sight clearance and said second sight clearance are sufficient for a participant holding onto said handrails to see underwater in a forward direction unobstructed by said bottom surfaces of said floats.

26. A device according to claim 25, wherein said first and second sight clearances are equal to approximately half a meter.

27. A device according to claim 20, wherein said first float, said second float and said joining member are integrally formed.

28. A device according to claim 20, wherein said handrails have a zig-zag shape.

29. A device according to claim 20, further comprising:

audio communications means attached to said frame for providing audio communication to participants, whereby said participants can hear an audio program while submerged and holding onto said handrail and being towed.

30. A group underwater towing device for towing participants in a group underwater tour, comprising:

a first elongated buoyant float having a first front end and a first bottom surface;

a second elongated buoyant float having a second front end and a second bottom surface;

a joining member having a downwardly extending portion attached to said front ends and positioning said floats to form a "V" shaped frame having an apex, whereby said floats form the legs of said frame and said joining member forms the apex of said frame, and whereby said frame and said apex define a forward direction;

an electric motor attached to said downwardly extending portion;

an electric power source supported by said frame and operably connected to said motor;

a propeller operably attached to said motor;

control means for controlling and steering said motor;

a first handrail mounted on said first float extending downwardly below said first bottom surface to a first handrail depth, said first handrail depth and said first bottom surface defining a first sight clearance;

a second handrail mounted on said second float extending downwardly below said second bottom surface to a second handrail depth, said second handrail depth and said second bottom surface defining a second sight clearance; and participant breathing means attached to said frame for allowing a participant to breathe while submerged and holding onto said handrail and being towed.

31. A device according to claim 30, wherein said first and second handrails comprise a plurality of handrails.

32. A device according to claim 30, wherein said participant breathing means comprises:

a compressed air source supported by said frame;

a plurality of hoses having source and regulator ends attached at said source ends to said source; and a plurality of breathing regulators attached to each of the regulator ends of said hoses.

33. A device according to claim 32, wherein said compressed air source is selected from the group consisting of air compressors and compressed air tanks.

34. A device according to claim 30, wherein said electrical power source is selected from the group consisting of solar cells, batteries, and generators powered by air breathing engines.

35. A device according to claim 30, wherein said control means comprises a pistol grip control operably connected to said motor.

36. A device according to claim 30, further comprising:

audio communications means attached to said frame for communicating with said participants, whereby said participants can hear an audio program while submerged and holding onto said handrail and being towed.

* * * * *